US011280588B1

(12) United States Patent
Esquilin-Mangual et al.

(10) Patent No.: US 11,280,588 B1
(45) Date of Patent: Mar. 22, 2022

(54) READY ARMOR PROTECTION FOR INSTANT DEPLOYMENT AND LOADING

(71) Applicant: United States of America as Represented by The Secretary of The Army, Alexandria, VA (US)

(72) Inventors: Omar Esquilin-Mangual, Vicksburg, MS (US); Catherine S Stephens, Clinton, MS (US); Omar G Flores, Vicksburg, MS (US); Andrew B Edwards, Toney, AL (US); Erik M Chappell, Vicksburg, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 17/037,480

(22) Filed: Sep. 29, 2020

(51) Int. Cl.
*F41H 5/013* (2006.01)
*E04B 1/344* (2006.01)

(52) U.S. Cl.
CPC ..... *F41H 5/013* (2013.01); *E04B 1/3445* (2013.01)

(58) Field of Classification Search
CPC ... F41H 5/00; F41H 5/013; F41H 5/24; F41H 5/14; E04B 1/3445
See application file for complete search history.

(56) References Cited

U.S. PATENT DOCUMENTS

| | | | | |
|---|---|---|---|---|
| 4,016,686 | A * | 4/1977 | Hartger | E04H 6/005 52/65 |
| 7,647,731 | B2 * | 1/2010 | Muir | E04B 1/3445 52/79.5 |
| 7,882,659 | B2 * | 2/2011 | Gyory | E04B 1/3444 52/79.5 |
| 8,701,356 | B2 * | 4/2014 | Forsland | E04B 1/19 52/66 |
| 8,978,318 | B2 * | 3/2015 | Klein | F41H 5/24 52/71 |
| 9,221,599 | B2 * | 12/2015 | Brennan, Jr. | B65D 88/524 |
| 10,279,990 | B2 * | 5/2019 | Ronstadt | B60P 3/42 |
| 10,738,459 | B2 * | 8/2020 | Brown | E04H 15/48 |
| 10,739,113 | B1 * | 8/2020 | Bosen | F41H 11/00 |
| 10,775,138 | B1 * | 9/2020 | Esquilin-Mangual | E04H 9/04 |
| 11,073,361 | B1 * | 7/2021 | Grigsby | F41H 5/24 |
| 2006/0043060 | A1 * | 3/2006 | Guthrie | G11B 5/3163 216/22 |

(Continued)

*Primary Examiner* — Joshua E Freeman
(74) *Attorney, Agent, or Firm* — Brian C. Jones

(57) ABSTRACT

Ready armor modular protective systems that can be rapidly deployed in an urban environment. Exemplary armor systems include a container, and a wall assembly that fits inside of the container when in a collapsed configuration. The wall assembly includes a first end section, a second end section, a constraint mechanism, and first and second locking mechanisms. The first end section has a first space frame unit, and the second end section has second and third space frame units. A locking mechanism prevent relative vertical displacement from occurring between adjacent second and third space frame units. The constraint mechanism keeps the first and third space frame units at a fixed distance from one another. The constraint mechanism, when coupled with the first and third space frame units, keeps the locking mechanism from being removed from the second end section.

20 Claims, 9 Drawing Sheets

(56) References Cited

U.S. PATENT DOCUMENTS

| | | | | |
|---|---|---|---|---|
| 2008/0092731 | A1* | 4/2008 | Hall | F41H 5/06 89/36.04 |
| 2012/0174763 | A1* | 7/2012 | Ritchie | F41H 5/06 89/36.04 |
| 2016/0138258 | A1* | 5/2016 | Schaffert | E04B 1/34357 52/79.5 |
| 2016/0238349 | A1* | 8/2016 | White | F41H 11/08 |
| 2017/0114562 | A1* | 4/2017 | Oesch | E04H 12/08 |
| 2017/0205206 | A1* | 7/2017 | Horch | F41H 5/24 |
| 2018/0073841 | A1* | 3/2018 | DeKort | F41H 5/08 |
| 2018/0303226 | A1* | 10/2018 | Weaver, Jr | F41H 5/013 |
| 2018/0313074 | A1* | 11/2018 | Brown | E04B 1/3445 |
| 2019/0234094 | A1* | 8/2019 | Nead | E04H 9/10 |
| 2020/0256647 | A1* | 8/2020 | Howell | F41H 5/0407 |
| 2020/0284061 | A1* | 9/2020 | Pezzola | E04G 25/065 |
| 2020/0284553 | A1* | 9/2020 | Esquilin-Mangual | E04H 9/04 |
| 2021/0102398 | A1* | 4/2021 | Nead | E04H 15/34 |
| 2021/0215459 | A1* | 7/2021 | Chen | F41H 5/0492 |
| 2021/0278176 | A1* | 9/2021 | Merritt, II | F41H 5/007 |

* cited by examiner

READY ARMOR PROTECTION FOR INSTANT DEPLOYMENT AND LOADING

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to protective structures and, more particularly but not exclusively, to rapid deployment protective walls that can be used in an urban setting.

Description of the Related Art

This section introduces aspects that may help facilitate a better understanding of the invention. Accordingly, the statements of this section are to be read in this light and are not to be understood as admissions about what is prior art or what is not prior art.

To protect personnel and assets, organizations such as the military use a variety of protective materials ranging from soil cover to expensive, high-performance, lightweight ballistic ceramics. For the military, a need exists for armor protection systems that can be rapidly deployed in an urban environment. Currently known barriers are described in U.S. Pat. No. 8,464,493 issued Jun. 18, 2013 "Transportable Modular Configuration For Holding Panels", in U.S. patent application Ser. No. 12/920,497 filed Mar. 2, 2009 "Transportable Modular System Permitting Isolation of Assets", and in U.S. Pat. No. 10,775,138 which issued 15 Sep. 2020 "Ready Armor Protection For Instant Deployment". The content of each of the above filings is incorporated herein by reference.

Although currently available protection systems provide valuable protection in many instances, still further improvements are desirable. Embodiments of the present invention provide solutions to at least some of these outstanding needs.

SUMMARY

The present invention was developed to address the challenges described in the Background section. Additional research and further development has led to a novel approach to provide improved protective barriers for use in an urban environment.

It is important to protect both material and personnel from catastrophe, especially in cases where the probability of occurrence is greater than the norm. Conventionally, both temporary and permanent means may be used for this purpose, depending on the scenario. For example, a permanent military facility may best be protected by a permanent configuration, whereas a mobile field unit would best be served by a temporary, but not necessarily less effective, configuration. Conventionally, protection against manmade catastrophe, such as occurs in war zones, has been provided with large bulky concrete structures or earthen embankments that require heavy equipment to produce, whether temporary or permanent. Common needs for protective structure may include barriers to prevent personnel access, vehicular intrusion, or even line-of-site access, as well as protective enclosures for emergency response personnel or revetments for high value assets. Select embodiments of the present invention provide good protection for both personnel and valued assets and are of value for the protection of military, industrial, community and personal assets. Embodiments of the present invention also can be implemented quickly and efficiently in an urban environment.

The structures and methods for Ready Armor Protection For Instant Deployment (RAPID) disclosed herein provide improved levels of protection over that which is provided by many known protective structures from small arms, fragmenting rounds, improvised explosives, and blast threats.

A RAPID system provides an early entry system for instant protection, and can support personnel operating in dense urban environments in site exploitation and hasty defense. RAPID systems can be deployed and tailored to create road blocks/checkpoints, support cordon and countermobility operations, creating buffer zones, providing blast and ballistic protection (e.g. for urban blocks), managing pedestrian traffic, and establishing concealment and perimeter security. In some cases, RAPID systems can include space frame units having wheels, so as to facilitate ease of setup and takedown. In some cases, RAPID systems can be deployed in a matter of minutes. Exemplary RAPID systems are scalable and/or recoverable.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Embodiments of the present invention encompass Ready Armor Protection for Instant Deployment (RAPID) systems, and methods for their use and manufacture. RAPID is a quickly deployable wall system designed to provide blast and ballistic protection, to prevent intrusion, and to serve as Line-of-Sight Denial in an urban setting. RAPID systems are scalable and recoverable and can be tailored to meet specified threats. RAPID systems can be delivered in Quadcons and on palletized loading system (PLS) trucks. In some cases, up to 130 linear feet of early protection wall are provided per PLS truck. RAPID systems can be used as Entry Control Point (ECP) boundaries and/or perimeters. RAPID systems are well suited for use in urban environments, and can be deployed on paved roads. In some cases, RAPID systems can be deployed on a typical 20' ISO, Quadcons or Tricons over PLS Truck (containers removed). In some cases, RAPID systems can be deployed on a road having a maximum road slope of 10% longitudinal and 5% transversal. In some cases, RAPID systems can be deployed on a road having a maximum slope change of 10%. Embodiments of the present invention include a variety of features which facilitate deployment of a wall assembly to a location having a positive or negative slope.

Figure 1:
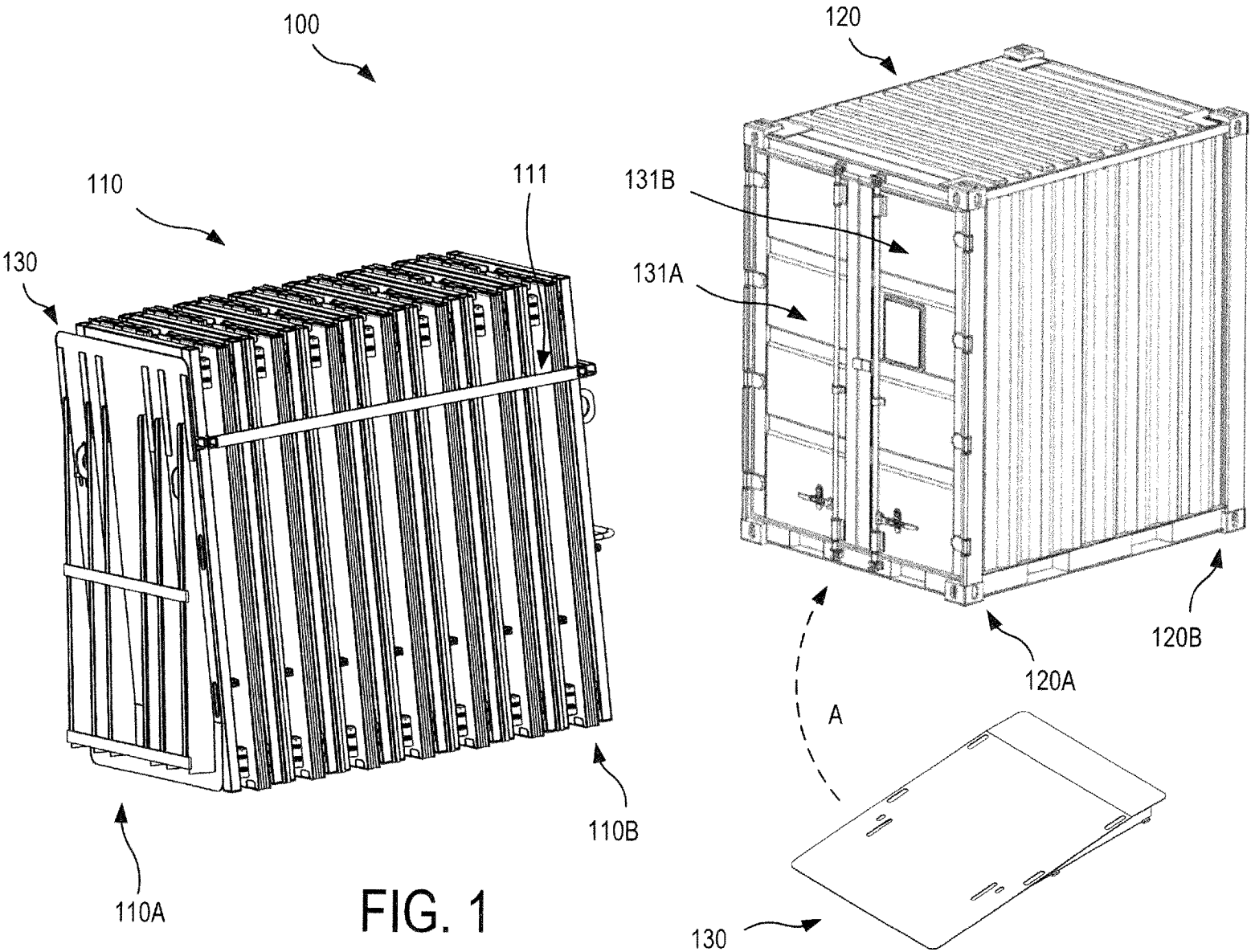
FIG. 1 depicts aspects of an exemplary Ready Armor Protection for Instant Deployment (RAPID) system, including a wall assembly in a closed configuration, a container, and a ramp, according to certain embodiments of the invention.

Turning now to the drawings, FIG. 1 depicts aspects of an exemplary armor system 100 according to embodiments of the present invention. As shown here, armor system 100 includes a wall assembly 110, a container 120, and a ramp 130. During transport, the ramp 130 can be stowed approximate to or coupled with the wall assembly 110, and both the wall assembly 110 and the ramp 130 can be stored within the container 120.

During the deployment process, the doors 131A, 131B of the container can be opened, the ramp 130 can be removed from the container 120 and placed on the ground near the container 120 (e.g. as indicated by arrow A), and the wall assembly 110 can be removed from the container 120 and rolled or moved down the ramp 130.

In FIG. 1, the wall assembly 110 is illustrated in a closed or collapsed configuration. Wall assembly 110 includes a first end section 110A and a second end section 110B. Container 120 includes a first end section 120A and a second end section 120B. The armor system 100 can be operated on leveled or unleveled ground. In some cases, the wall assembly 110 operates as a portable, reusable barrier wall, and can be used on paved surfaces. The wall assembly 110 can be integrated into the container 120 for storage, transport, and use. As discussed elsewhere herein, when the wall assembly 110 is in an open or expanded configuration, the wall assembly 110 can form a solid barrier wall that provides ballistic protection, intrusion prevention, and/or line-of-sight denial.

The wall assembly 110 may be extremely heavy and difficult to move by a single person. In some cases, a wall assembly 110 may include integrated caster wheels to facilitate movement. In some cases, a wall assembly 110 can be moved using material handling equipment (MHE). In some cases, users may move the wall assembly 110 along the ground when emplacing, relocating, removing, and stowing the wall assembly 110. When expanding, stowing or transporting the wall assembly 110 outside of the container 120, an individual such as a soldier may push and/or pull the wall assembly 110 into position and/or use a winch. In some cases, a wall assembly 110 can include one or more designated grasp areas.

Prior to deployment, the wall system 110 can positioned in the collapsed configuration and placed or stored in the container 120. The container 120 may be transported on a trailer, forklift, pickup truck, or some other transportation mechanism to a deployment site. In some cases, a wheeled trailer may be a preferred means for moving the container, as a trailer can be moved quickly, and therefore a protection structure provided by a wall assembly can be established quickly. In some cases, the container 120 (with the wall assembly 110 contained therein) can be removed, disengaged, or dropped from the trailer, so that the second end section 120B of the container 120 is near a wall or other obstacle. In some cases, the second end section 120B can be placed about 2.5 feet from a wall or obstacle. After the container 120 is in place, the doors 131A, 131B can be opened, and the ramp 130 may be removed and placed on the first end section 120A (or wall deployment side) of the container 120. Lifting jacks can be connected with the second end section 120B of the container 120 (opposite side of the ramp), and a ratchet wrench can be used to actuate the lifting jacks, so as to raise the second end section 120B of the container 120 from the ground (e.g. 3.5 inches from the ground). By raising the second end section 120B of the container 120 in this way, it is possible to create a slope, or to increase a slope, upon which the wall assembly is positioned, and thereby it can be easier to move the wall assembly out of the container.

When deploying the wall assembly on a negative slope, the wall assembly is moved down a hill or grade. In such a situation, the container is situated uphill, and the wall assembly is rolled downhill out of the container. It is possible to use the container weight and friction between the container and the ground, so that the container serves as anchor point, to hold, contain, or control the wall assembly while the wall assembly is deployed or rolled downhill. When deploying the wall assembly on a positive slope, the wall assembly is moved up a hill or grade. A Humvee or F250 truck, or other vehicle or transportation mechanism, can be used as an anchor point to pull the wall assembly out of the container and up the grade. For example, a jeep having a winch can be coupled with the wall assembly via a cable, strap, or chain, and the winch can be operated so as to pull the wall assembly out of or away from the container and up the hill.

Figure 2:
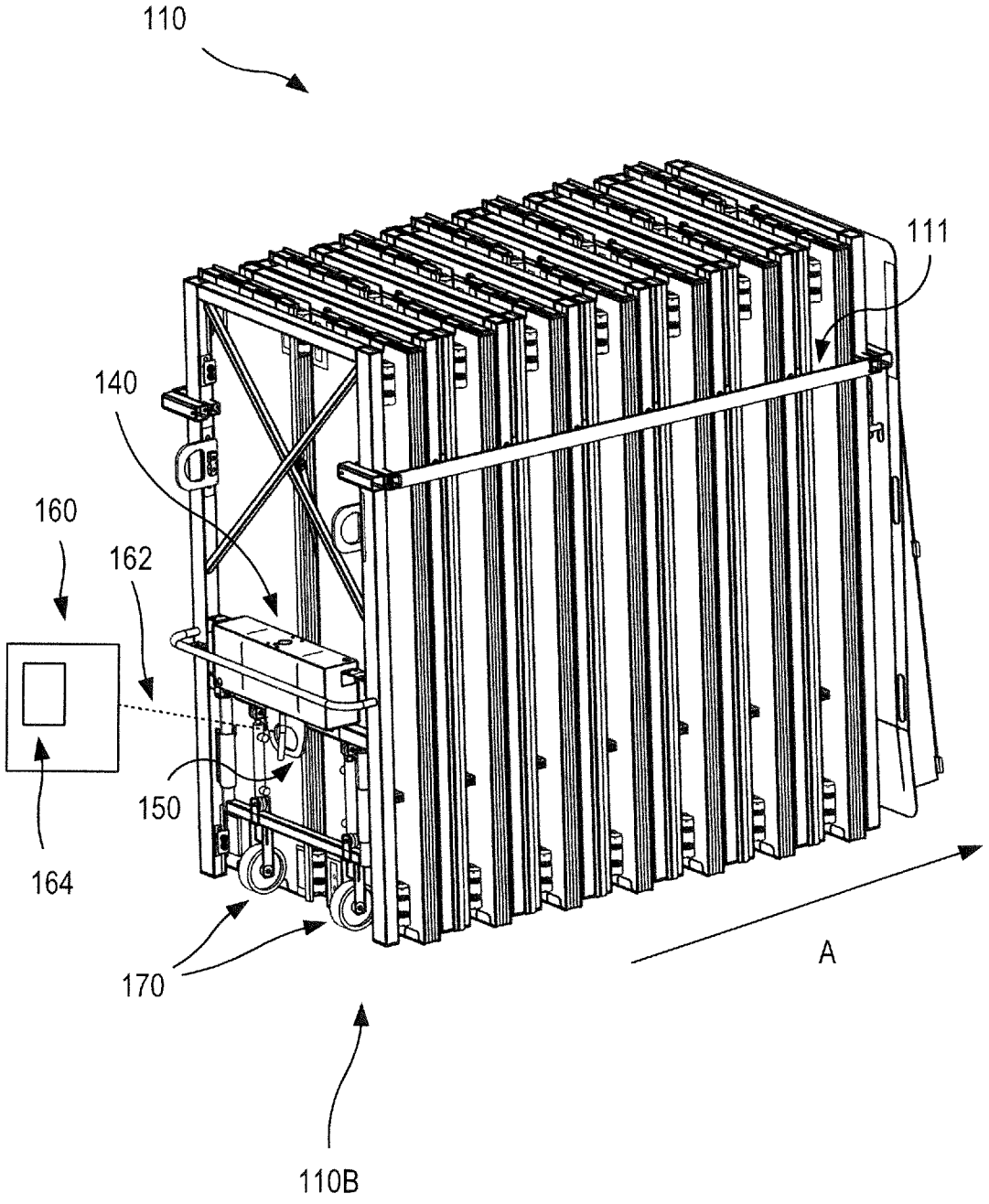
FIG. 2 depicts aspects of an exemplary Ready Armor Protection for Instant Deployment (RAPID) system, including a wall assembly and a winch, according to certain embodiments of the invention.

As shown in FIG. 2, the second end section 110B of the wall assembly 110 includes a hydraulic pump control mechanism 140 and a winch attachment mechanism 150. When the ramp 130 is in place and the second end section 120B of the container 120 has been raised, a winch 160 can be connected to the winch attachment mechanism 150 via a winch connector 162, which in some cases may be a cable or a strap. The hydraulic pump control mechanism 140 can be activated, so as to lower the wheels 170 so that they contact the floor of the container. As the wall assembly 110 is expanded or moved out of the container in the direction indicated by arrow A, the winch 160 and winch connector 162 can be used to provide controlled movement of the wall assembly 110, for example to keep the wall assembly 110 from exiting the container too quickly or from rolling down an incline (e.g. down the ramp) too quickly. For example, the winch 160 may include a brake mechanism 164, the brake mechanism 164 can be operated to provide controlled movement of the wall assembly 110, for example by providing controlled movement of the second end section 110B of the wall assembly. In some cases, the winch 160 can be coupled with the container. For example, the winch 160 can be coupled with the container via one or more winch brackets (not shown).

Any of a variety of material handling equipment (MHE), forklifts, pickup trucks, or some other transportation mechanisms can be used to help move the wall assembly 110 out of the container and/or expand the wall assembly 110.

In some cases, the wall assembly 110 is removed from the container 120 while the wall assembly is in the closed or collapsed configuration. As shown in FIG. 1, a wall assembly 110 can include a constraint mechanism 111 that can operate to keep the wall assembly 110 in the collapsed or closed configuration. For example, the constraint mechanism 111 may operate to keep the first end section 110A and the second end section 110B from moving away from each other when the wall assembly 110 is in the collapsed or closed configuration. In some cases, the constraint mechanism 111 may include one or more side tubes. In some cases, the constraint mechanism may include one or more straps. In the embodiment depicted shown in FIG. 1, the constraint mechanism 111 includes a side tube having a first end and a second end, where the first end of the tube is coupled with a frame unit at the first end section 110A and the second end of the tube is coupled with a frame unit at the second end section 110B. The constraint mechanism 111 can also include another side tube (not shown) on the opposing side of the wall assembly 110, where the other side tube has a first end that is coupled with a frame unit at the first end section 110A and a second end that is coupled with a frame unit at the second end section 110B.

The winch brake 164 (depicted in FIG. 2) can be operated to allow the constrained wall assembly 110 to roll out of the container and down the ramp. In some cases, gravity alone can operate to allow the wall assembly to roll out of the container. When the wall assembly 110 is out of the container and on the ground, rubber wheel chocks can be placed on the rolling side of the wall assembly (e.g. the first end section 110A of the wall assembly 110). The constraint mechanism 111 can be removed and the wall assembly can be expanded or opened.

Figure 3A:
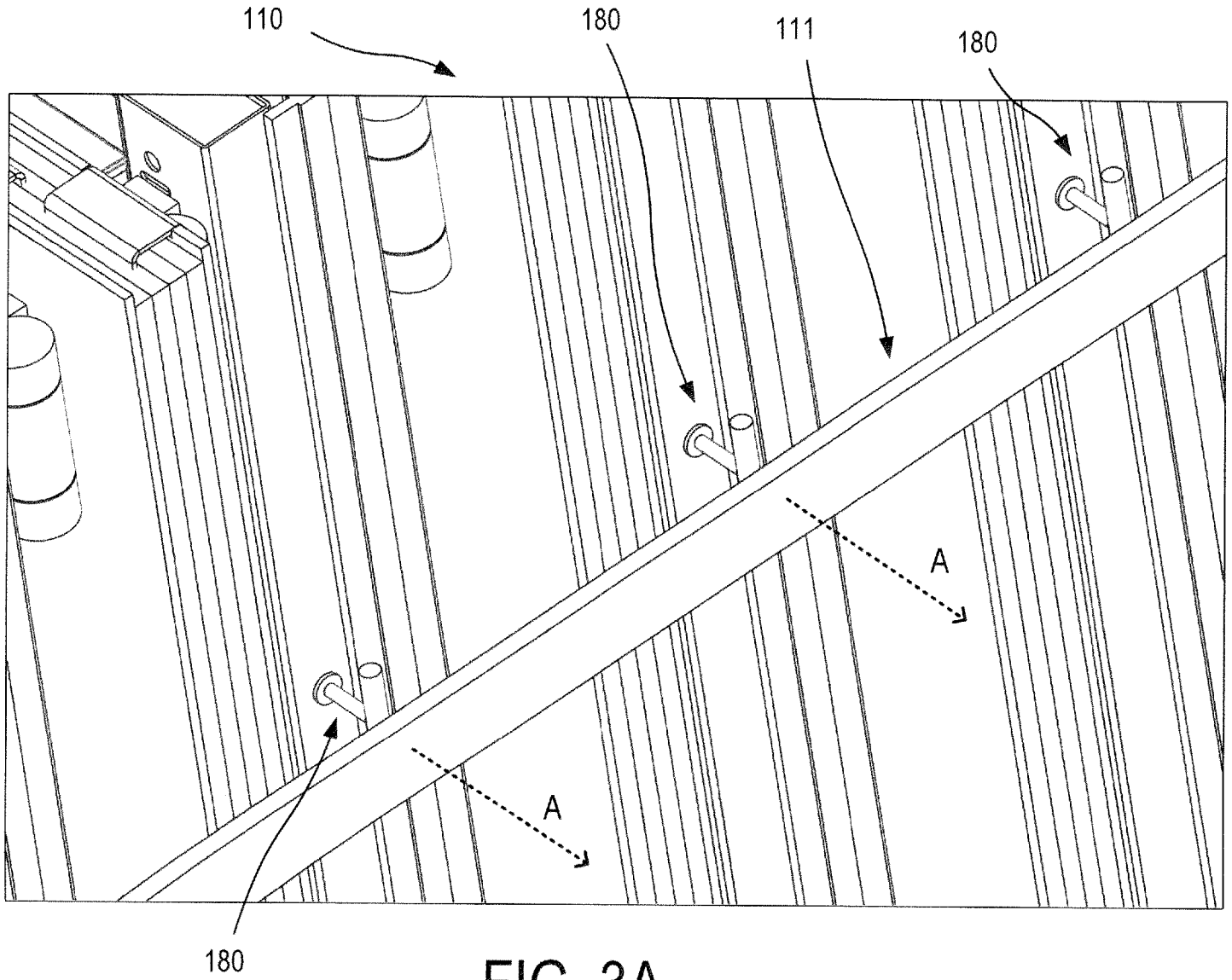
FIGS. 3A and 3B depict aspects of an exemplary Ready Armor Protection for Instant Deployment (RAPID) system, including locking mechanisms and a constraint mechanism, according to certain embodiments of the invention.

As shown in the partial perspective view of FIG. 3A, a wall assembly 110 can include one or more locking pins 180. In use, a locking pin can operate to keep an individual collapsible space frame unit of the wall assembly 110 from moving up or down relative to an adjacent individual collapsible space frame unit of the wall assembly 110 in a partially open, closed, folded, or collapsed configuration. When the constraint mechanism is removed from the wall assembly, the locking pins can still prevent individual frame units from unfolding. Hence, the locking pins 180 can be removed, for example by pulling the pins in a direction indicated by the A arrows (after the constraint mechanism 111 has been removed) so that the individual frame units can unfold. Typically, a pair of locking pins (or in some cases, a single locking pin) operates to keep a single individual frame unit from unfolding. In some cases, a deployment process can begin by removing one or more locking pins 180 toward the first end section of the wall assembly 110, so that those frame units toward the first end section are able to unfold, while units toward the second end section are not unable to unfold (because locking pins are still holding those units in the folded configuration). Advantageously, the constraint mechanism 111, when coupled or engaged with the frame units at each end of the wall assembly, operates to keep the locking pins 180 from being removed from the locked frame units. Further advantageously, this sequential unlocking of the locking pins, from one end section of the wall assembly to the other end section of the wall assembly, can help to prevent racking or tilting of the space frame units during deployment of the wall assembly 110. When the units are unfolded, the wall assembly 110 can be straightened by grabbing the armor panels from their brackets. When the wall assembly 110 is in the open configuration and in place as desired, the hydraulic pump control mechanism can be actuated, so that the wheels are raised and/or the panels of the wall are dropped to the ground. In some cases, such actuation of the pump control mechanism can involve releasing a relief valve of the pump control mechanism. In addition to or in place of the locking pins, any of a variety of locking mechanisms can be used to prevent individual frame units from unfolding. In some embodiments, a locking mechanism such as a locking pin 180 can operate to prevent a frame unit from unfolding.

Figure 3B:
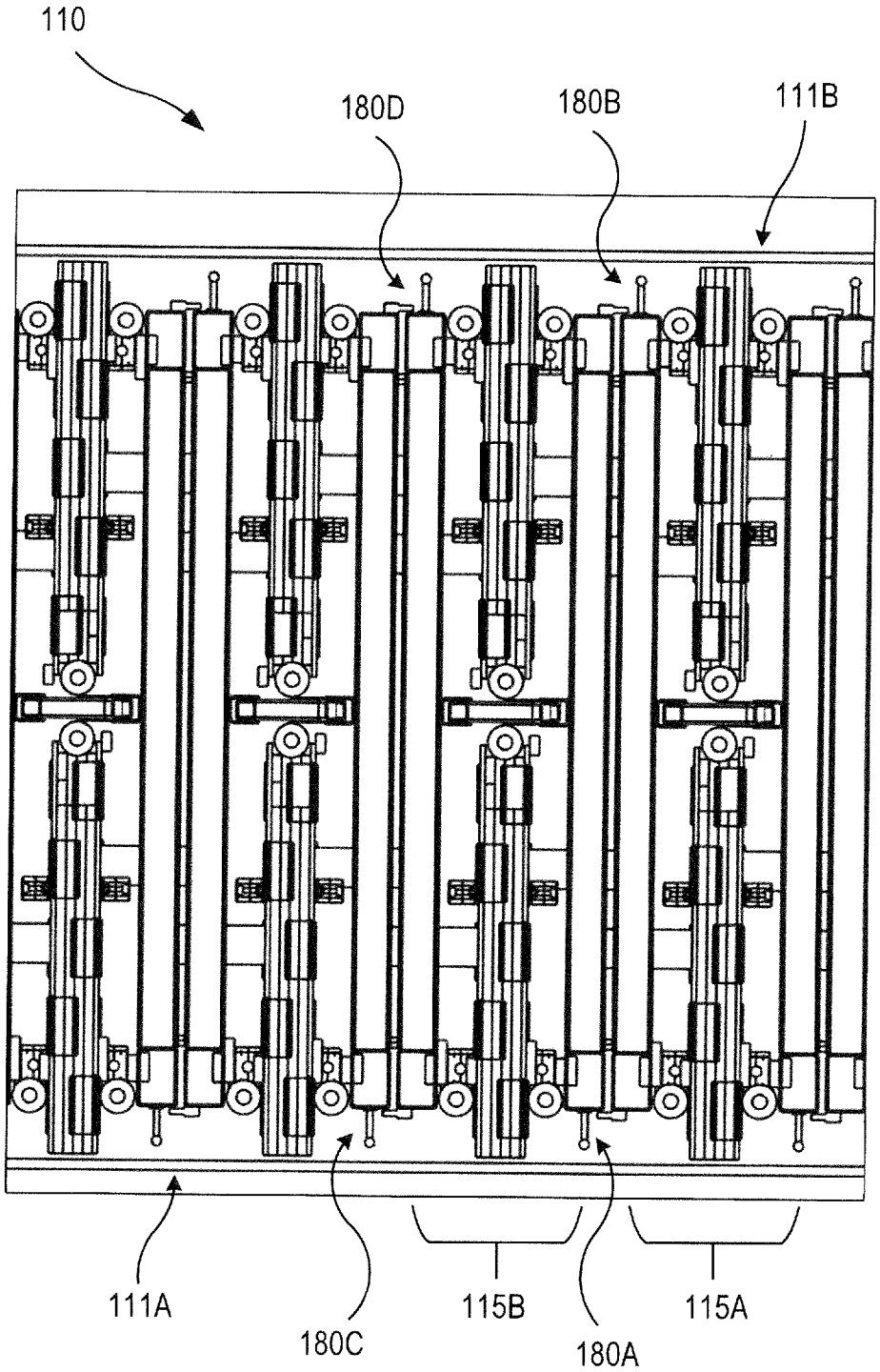
Figure 4:
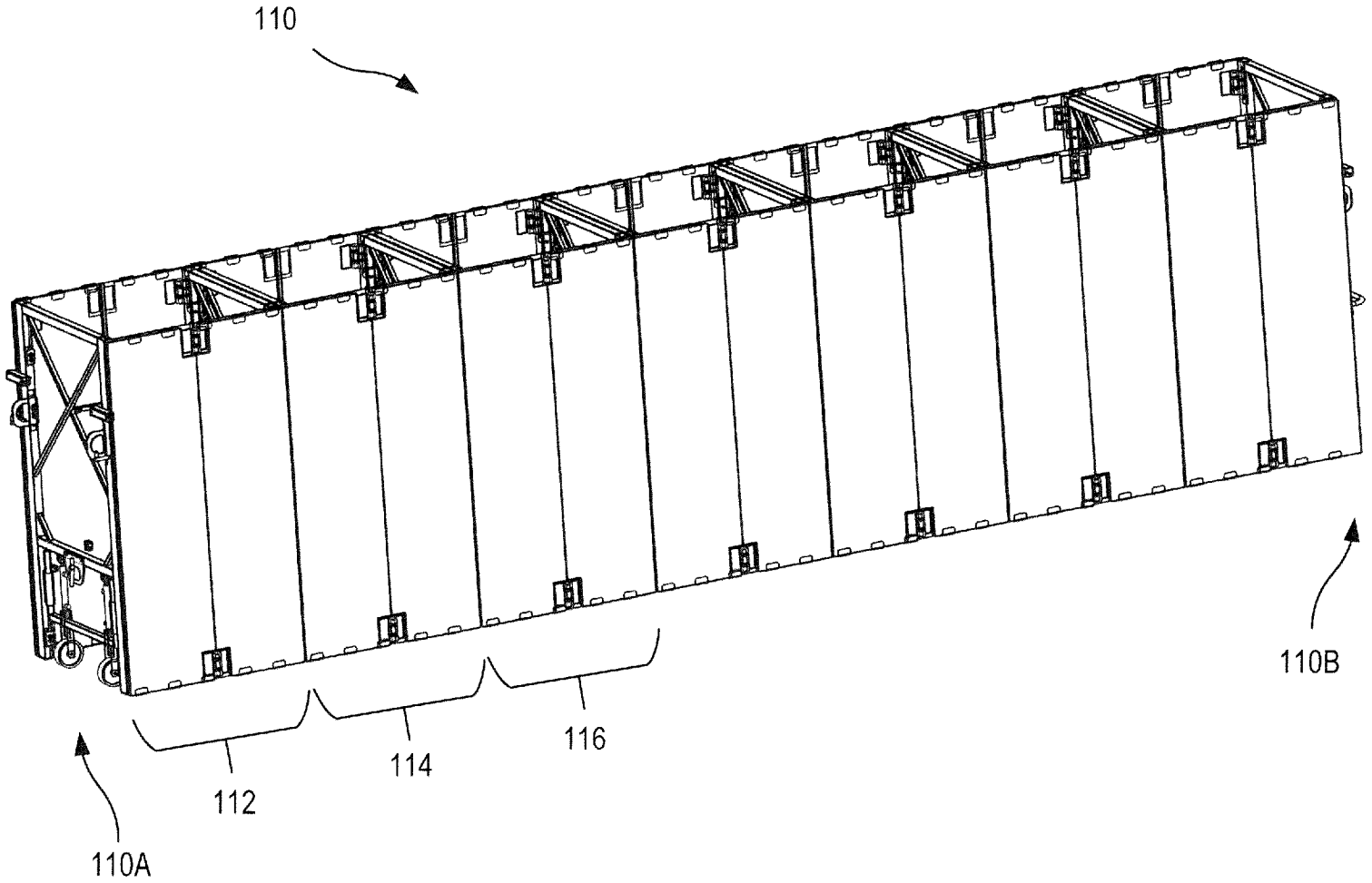
FIG. 4 depicts aspects of an exemplary Ready Armor Protection for Instant Deployment (RAPID) system, including a wall assembly in an open configuration, according to certain embodiments of the invention.

As shown in the partial top plan view of FIG. 3B, a wall assembly 110 can include one or more locking mechanisms or pins (e.g. 180A, 180B, 180C, and 180D). In use, a locking pin can operate to keep an individual collapsible space frame unit of the wall assembly from moving up or down relative to an adjacent individual collapsible space frame unit of the wall assembly in a partially open, closed, folded, or collapsed configuration. In some cases, such relative vertical displacement between adjacent individual collapsible space frame units of the wall assembly can be due to the presence of slotted connections between adjacent space frame units, which are described in U.S. Pat. No. 10,775,138 which issued 15 Sep. 2020 "Ready Armor Protection For Instant Deployment". In some cases, the slotted connections allow ground differentials (bumps) adaptability, but can also introduce or make the wall assembly susceptible to racking or tilting of the space frame units during deployment of the wall assembly 110. Advantageously, locking pins solve such racking issues. In exemplary embodiments, locking pins for one half of the wall assembly 110 can be removed first, and the first three units can be unfolded. Thereafter, the remainder of the locking pins can be removed, and the rest of the units can be unfolded. The opened units can provide sufficient stability to prevent racking, similar to having the locking pins in place on one half of the wall assembly. In some cases, locking pins can operate in tandem. Hence, for example, locking pins 180A and 180B can operate to keep frame unit 115A from sliding up or down relative to an adjacent individual collapsible space frame unit 115B of the wall assembly, and locking pints 180C and 180D can operate to keep frame unit 115B from sliding up or down relative to an adjacent individual collapsible space frame unit of the wall assembly. When the constraint mechanism, which may include side tube 111A and 111B, is removed from the wall assembly, the locking pins can still prevent individual frame units from unfolding completely. In exemplary embodiments, the locking pins hit the armor panels preventing them from fully open as shown in FIG. 4. Hence, the locking pins can be removed so that the individual frame units can unfold. In some cases, a pair of locking pins (e.g. locking pins 180A and 180B) can be referred to as a locking mechanism, for example a locking mechanism for frame unit 115A.

FIG. 4 depicts a perspective view of a wall assembly 110 in the expanded or open configuration. The wheels have been retracted upward, and the wall panels are resting on the ground. As depicted here, wall assembly 110 includes multiple collapsible space frame units (e.g. 112, 114, 116, and so on). Adjacent space frame units can be coupled via slot and pin connecting mechanisms, as described in previously incorporated U.S. Pat. No. 10,775,138 which issued 15 Sep. 2020 "Ready Armor Protection For Instant Deployment". One or more slot and pin connecting mechanism pairs can be referred to as vertically adjustable coupling mechanisms. As such, the coupling mechanisms (e.g. slot and pin connecting mechanisms) can provide for relative displacement between adjacent space frame units when the frame units are connected.

The frame units are in an open, unfolded, or uncollapsed configuration in FIG. 4, and are in a closed, folded, or collapsed configuration in FIGS. 1-3B. To facilitate ease of setup and/or takedown, RAPID systems can include or be used with a winch mechanism, whereby space units are extended and/or retracted by operation of the winch, optionally in combination with a cable (e.g. IA inch cable) that is in operative association with the space units. As seen in these figures, the wall assembly has an internal frame system that operates in a manner similar to an accordion, and the wall assembly includes armor panels or plates engaged with the internal frame system. When the wall assembly 110 is in place as desired, the winch connector may be removed from the wall assembly.

With returning reference to FIG. 1, in some embodiments, container 120 can be an ISO 20' container, having a tare/payload of 4,740/62,460 lbs. In some embodiments, container 120 can be a QUADCON Type II container, having a tare/payload of 2,120/9,040 lbs. An armor kit may include multiple Quadcon containers. For example, a basic armor configuration kit may include 4 Quadcon containers, with 7 space frame units per Quadcon container. A full armor configuration kit may include 3 Quadcon containers, with 6 space frame units per Quadcon container, plus an additional Quadcon container that includes 144 armor panels. An armor kit can provide various protective wall lengths. For example, with a Palletized Load System (PLS) truck having a Type II Quadcon capacity, a basic armor configuration kit can provide 130' of protective wall length, and a full armor configuration can provide 97.5' of protective wall length. Table 1 provides exemplary space, weight, and PLS truck limitations according to embodiments of the present invention. In some cases, a PLS truck lifting capacity can be 16.5 ton.

TABLE 1

| Limitation | Typical Quadcon | Typical 20' ISO Container |
|---|---|---|
| Space | 7 Units w/E-Glass = 32.5' including armored Quadcon | 40 Units w/E-Glass = 160' including armored 20' ISO |
| Weight | 6 Units w/E-Glass = 29' including armored Quadcon | 40 Units w/E-Glass = 160' including armored 20' ISO |
| PLS Truck | 34 Quadcons w/6 Units/ Quadcon w/E-Glass each = 29' (87'/Truck) | 20 Units w/E-Glass = 90' including armored 20' ISO |
| PLS Truck | 4 Quadcons w/7 Units/ Quadcon No E-Glass each = 32.5' (130'/Truck) | 30 Units No E-Glass = 125' including armored 20' ISO |

In some case, a wall assembly composed of multiple frame units can be pre-manufactured or pre-assembled, placed inside of a Quadcon, Tricon or ISO container, transported to an installation site, and then pulled or removed from the Quadcon, Tricon or ISO container at the desired location. In some cases, the Quadcon, Tricon or ISO container can be attached to the wall assembly, so that the Quadcon, Tricon or ISO container provides protection as an extension of the wall assembly itself. In some cases, the Quadcon, Tricon or ISO container can include supplemental armor plates or mechanisms for enhanced fortification (e.g. positioned within the interior of the Quadcon, Tricon or ISO container). In some cases, the container's length can be included in the protective length, and by using the container for protection, it is possible to reduce logistics issues related to of putting them away after emplacing the units.

Figure 5:
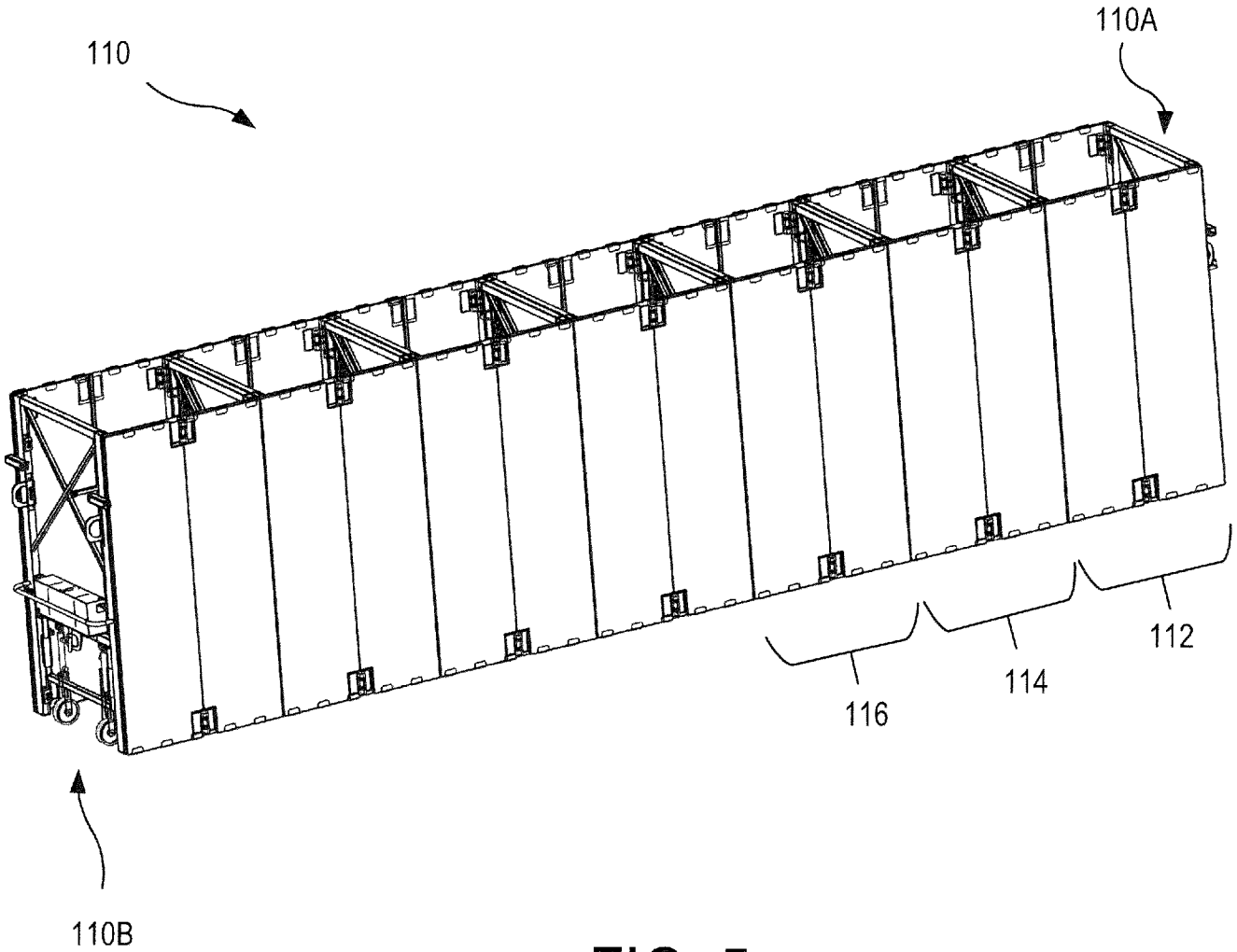
FIG. 5 depicts aspects of an exemplary Ready Armor Protection for Instant Deployment (RAPID) system, including a wall assembly in an open configuration, according to certain embodiments of the invention.
Figure 6A:
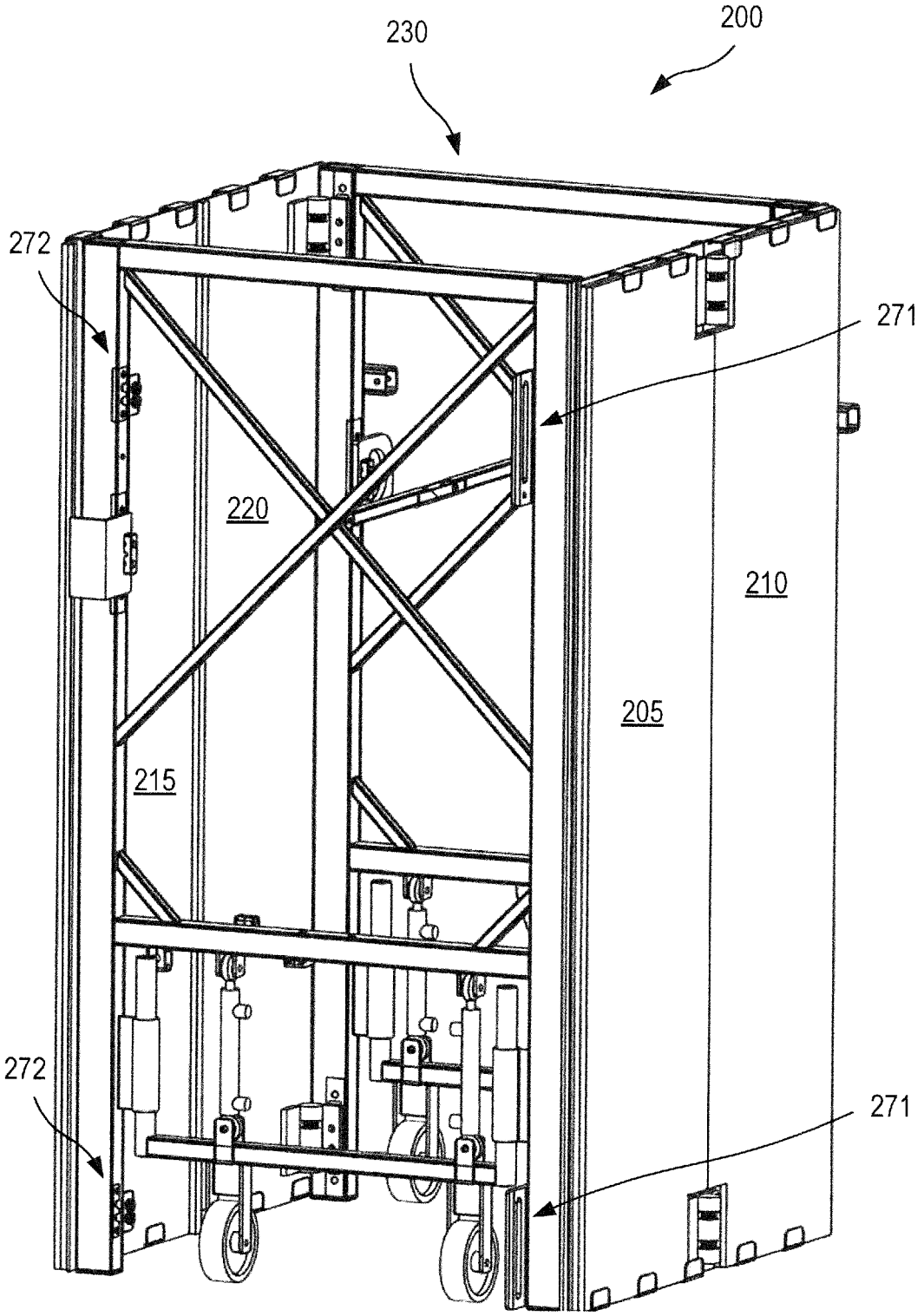
FIG. 6A depicts aspects of an exemplary Ready Armor Protection for Instant Deployment (RAPID) system, including a frame unit in an open configuration, according to certain embodiments of the invention.

FIG. 5 depicts another perspective view of a wall assembly 110 in the expanded or open configuration. FIG. 6A depicts aspects of an exemplary space frame unit 200 according to embodiments of the present invention. As shown here, frame unit 200 is in the uncollapsed, unfolded, or open configuration. Frame unit 200 includes a first inner wall panel assembly 205, a second inner wall panel assembly 210, a first outer wall panel assembly 215, and a second outer wall panel assembly 220. The panel assemblies are supported by a frame assembly 230. When a space frame unit is in an open or uncollapsed position, a locking bar can be locked, so as to maintain a fixed distance between horizontal frame members or cross supports of the space frame. When a locking bar is unlocked, the space frame unit can be closed or collapsed, whereby the horizontal frame members can be brought closer together, and whereby the cross supports can be brought closer together. It can also be seen that a frame unit 200 may have slot mechanisms 271 and pin mechanisms 272. Engagement between one or more slot mechanism of one frame unit and one or more pin mechanisms of an adjacent frame unit can operate to permit relative vertical displacement between the two adjacent space frame units. Additional details regarding the operation of such slot and pin connecting mechanisms are described in previously incorporated U.S. Pat. No. 10,775,138 which issued 15 Sep. 2020 "Ready Armor Protection For Instant Deployment". As discussed elsewhere here, a locking pin mechanism can be used to restrict or prevent such relative vertical displacement between adjacent space frame units, when the adjacent space frame units are coupled via the slot mechanism(s) and pin mechanism(s).

Figure 6B:
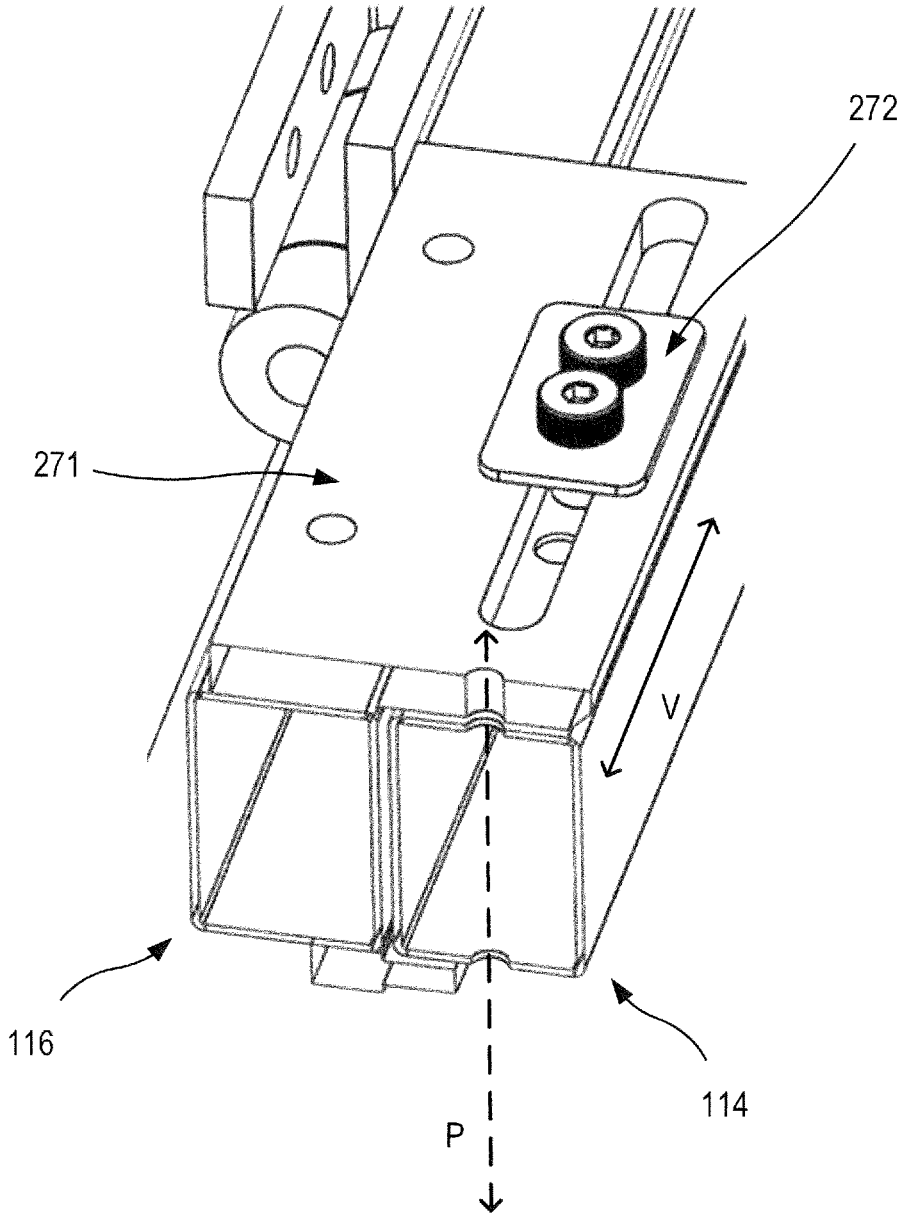
FIG. 6B depicts aspects of an exemplary Ready Armor Protection for Instant Deployment (RAPID) system, including a locking mechanism, according to certain embodiments of the invention.

FIG. 6B illustrates one approach to providing a locking pin mechanism, according to embodiments of the present invention. As depicted here, a locking pin (not shown here) can be inserted or retracted along a pin path P, which travels through one or more apertures of a first frame unit 114 and one or more apertures of a slot mechanism 271 of a second frame unit 116. When the locking pin is positioned in the apertures, the locking pin operates to prevent relative vertical movement (indicated by arrow V) between the first frame unit and the slot mechanism 271 of the second frame unit 116. When the locking pin is removed from the apertures, pin mechanism 272 of the first frame unit 114 and the slot mechanism 271 of the second frame unit 116 permit relative vertical movement between the first frame unit 114 and the second frame unit 116.

Following use of the wall assembly, it may be packed back into the container. To initiate the packing process, the winch connector can be attached with the wall assembly. For example, as depicted in FIG. 2, a winch connector 162 can be connected with a winch attachment mechanism 150 of a frame unit of the wall assembly.

Figure 7:
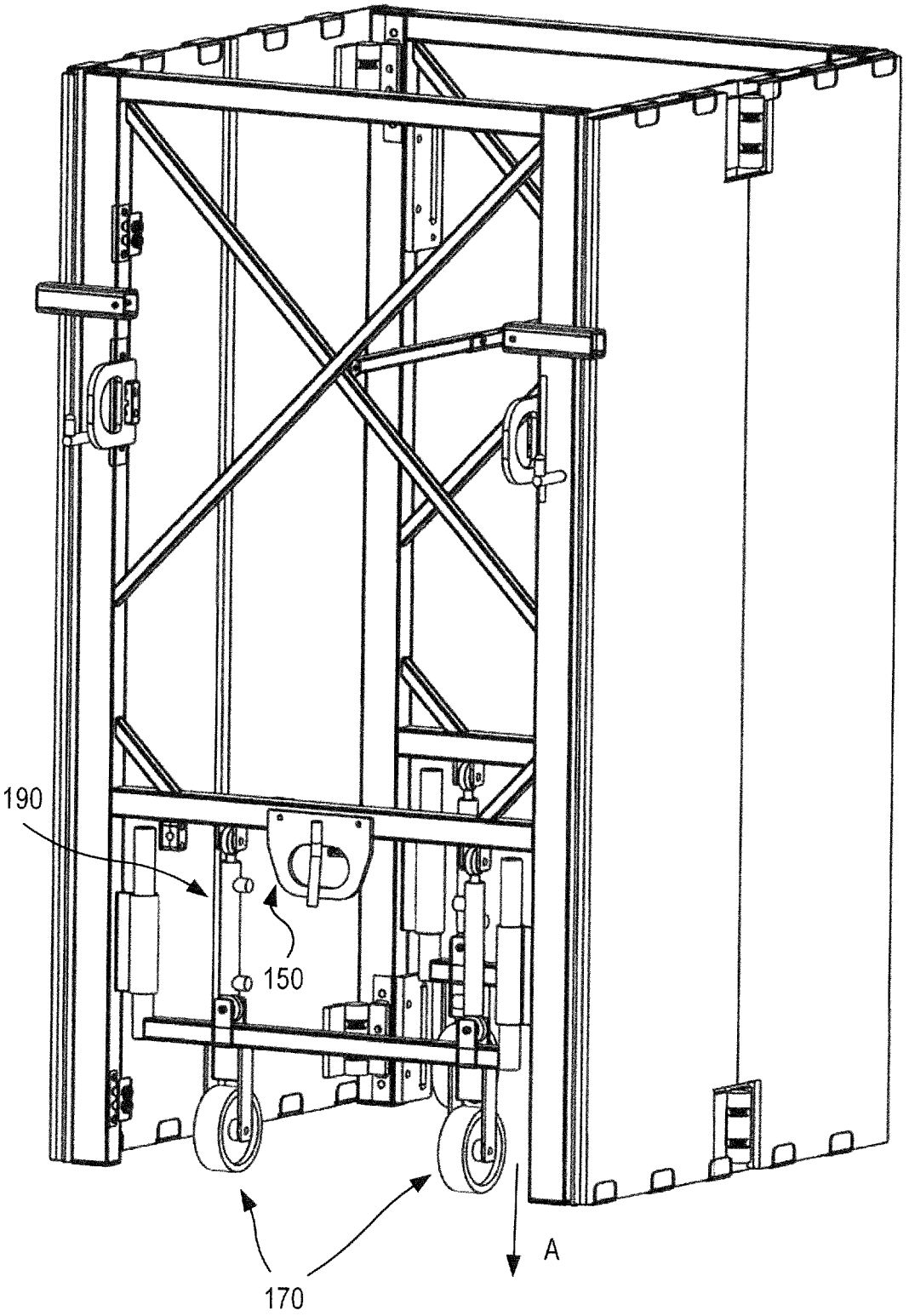
FIG. 7 depicts aspects of an exemplary Ready Armor Protection for Instant Deployment (RAPID) system, including a frame unit in an open configuration, according to certain embodiments of the invention.

According to some embodiments, the hydraulic pump control mechanism can then be actuated, so as to raise the panels off the ground (e.g. by extending the wheels 170 in a downward direction as shown by arrow A in FIG. 7, due to operation of hydraulic cylinders 190 which are in operative association with the hydraulic pump control mechanism). According to some embodiments, operation of the hydraulic cylinders is effective to move the panels of the frame assembly 230 up and down relative to the ground, while the wheels themselves remain in contact with the ground. In some embodiments, the space frame unit can roll along the surface of the ground when the wheels are extended (e.g. lower horizontal frame members are extended downward due to operation of the hydraulic cylinders), and the space frame unit can rest in a secure position upon the surface of the ground when the wheels are retracted (e.g. lower horizontal frame members are raised upward due to operation of the hydraulic cylinders). In some cases, the hydraulic cylinders can be attached with a hydraulic unit that is disposed within a Quadcon or ISO container via respective hydraulic lines. In some cases, manual jacks or other lifting/lowering mechanisms can be used to raise and lower the wheels (e.g. by raising and lowering the lower horizontal frame members). In some cases, multiple frame units can be raised and/or lowered simultaneously.

As the individual frame units are folded back into their closed or collapsed configuration, the locking pins can be replaced, so as to keep the individual frame units in the stable (un-racked) position. This can be done in a sequential manner, such that one frame unit is folded and locked with a locking pin, and then the next adjacent frame unit is folded and locked with a locking pin, and so on. As the frame units are folded, the rubber chocks can be used, and a wall cable can be adjusted as needed or desired, to maintain tension between the wall cable and the winch connector. When the wall assembly is in the closed or collapsed configuration, the constraint mechanism can be placed back on or reattached to the end frame units of the wall assembly. The ramp can be placed near the container. In some cases, this may require moving the collapsed wall assembly away from the container (to provide adequate space for the ramp), which can be facilitated by releasing tension on the winch connector. For example, the winch break can be released or relaxed. When the ramp is in place, the winch can be activated to draw the collapsed wall assembly up the ramp and into the container. The hydraulic pump control mechanism can be actuated so that the panels of the frame units drop back down to the floor or bottom support of the container (e.g. by raising the wheels of the frame units). The ramp can be removed from the ground and placed back on the wall assembly (e.g. by hanging the ramp on the wall assembly, as depicted in FIG. 1). The winch connector can be removed or detached from the wall assembly. The winch, wheel chocks, winch bracket, and jacks can be placed inside the container.

In some embodiments, a wall assembly in an open configuration can be attached to or placed adjacent to a container, so that the wall assembly and the container effectively combine to form a continuous barrier. In this way, the container can be used as part of the defense line provided by the wall assembly. In some cases, the container can be armorized or fortified to provide additional protection.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A ready armor modular protective system for rapid deployment, the system comprising:

a container; and a wall assembly having a first end section, a second end section, a hydraulic pump control mechanism, a constraint mechanism, a first locking mechanism, and a second locking mechanism, wherein the first end section includes a first space frame unit, and wherein the second end section includes a second space frame unit, a third space frame unit, and a fourth space frame unit;

wherein the first locking mechanism is configured to prevent relative vertical displacement from occurring between the third space frame unit and the fourth space frame unit, wherein the second locking mechanism is configured to prevent relative vertical displacement from occurring between the second space frame unit and the third space frame unit, and wherein the constraint mechanism is configured to prevent the first space frame unit and the fourth space frame unit from moving away from one another, and wherein the hydraulic pump control mechanism is configured to raise and lower armor panels of the first space frame unit, the second space frame unit, the third space frame unit, and the fourth space frame unit relative to a surface upon which the wall assembly is positioned.

2. The system according to claim 1, wherein the constraint mechanism, when engaged with the first space frame unit and the fourth space frame unit, is configured to prevent the first locking mechanism and the second locking mechanism from being removed from the second end section.

3. The system according to claim 1, wherein the first locking mechanism comprises a locking pin.

4. The system according to claim 1, wherein the first locking mechanism comprises a first locking pin and a second locking pin.

5. The system according to claim 1, wherein the constraint mechanism comprises a first side tube and a second side tube.

6. The system according to claim 1, wherein the constraint mechanism comprises a strap.

7. The system according to claim 1, further comprising a ramp that is releasably attached with the first space frame unit.

8. The system according to claim 1, further comprising a winch that is attached with the container, and a winch connector that is coupleable between the winch and the fourth space frame unit.

9. The system according to claim 1, further comprising a fifth space frame unit positioned between the first space frame unit and the second space frame unit.

10. A method of deploying a ready armor modular protective system, the method comprising:

placing the ready armor modular protective system at a deployment location, the ready armor modular protective system comprising a container and a wall assembly in a collapsed configuration contained within the container, the wall assembly having a first end section, a second end section, a hydraulic pump control mechanism, a constraint mechanism, a first locking mechanism, and a second locking mechanism, wherein the first end section includes a first space frame unit, wherein the second end section includes a second space frame unit, a third space frame unit, and a fourth space frame unit, wherein the first locking mechanism is configured to prevent relative vertical displacement from occurring between the third space frame unit and the fourth space frame unit, wherein the second locking mechanism is configured to prevent relative vertical displacement from occurring between the second space frame unit and the third space frame unit, and wherein the constraint mechanism is configured to prevent the first space frame unit and the fourth space frame unit from moving away from one another;

removing the wall assembly from the container while the wall assembly is in the collapsed configuration;

removing the constraint mechanism from the first space frame unit and the fourth space frame unit;

removing the first locking mechanism from the second end section;

unfolding the fourth space frame unit;

removing the second locking mechanism from the second end section;

unfolding the third space frame unit;

unfolding the second space frame unit;

unfolding the first space frame unit; and actuating the hydraulic pump control mechanism to lower armor panels of the first space frame unit, the second space frame unit, the third space frame unit, and the fourth space frame unit relative to a surface upon which the wall assembly is positioned.

11. The method according to claim 10, wherein the constraint mechanism, when engaged with the first space frame unit and the fourth space frame unit, is configured to prevent the first locking mechanism and the second locking mechanism from being removed from the second end section.

12. The method according to claim 10, wherein the first locking mechanism comprises a locking pin.

13. The method according to claim 10, wherein the first locking mechanism comprises a first locking pin and a second locking pin.

14. The method according to claim 10, wherein the constraint mechanism comprises a first side tube and a second side tube.

15. A ready armor modular protective system for rapid deployment, the system comprising:

a container;

a winch configured to couple with the container;

a winch connector; and a wall assembly configured to fit inside the container when the wall assembly is in a collapsed configuration, the wall assembly having a first end section, a second end section, a hydraulic pump control mechanism, a constraint mechanism, a first locking mechanism, and a second locking mechanism, wherein the first end section includes a first space frame unit, and wherein the second end section includes a second space frame unit, a third space frame unit, and a fourth space frame unit;

wherein the first locking mechanism is configured to prevent relative vertical displacement from occurring between the third space frame unit and the fourth space frame unit, wherein the second locking mechanism is configured to prevent relative vertical displacement from occurring between the second space frame unit and the third space frame unit, and wherein the constraint mechanism is releasably coupled with the first space frame unit and the fourth space frame unit and is configured to maintain the first space frame unit and the fourth space frame unit at a fixed distance from one another, wherein the hydraulic pump control mechanism is configured to raise and lower armor panels of the first space frame unit, the second space frame unit, the third space frame unit, and the fourth space frame unit relative to a surface upon which the wall assembly is positioned, wherein the constraint mechanism, when coupled with the first space frame unit and the fourth space frame unit, is configured to prevent the first locking mechanism and the second locking mechanism from being removed from the second end section, and wherein the winch connector is coupleable between the winch and the third space frame unit.

16. The system according to claim 15, wherein the first locking mechanism comprises a first locking pin and a second locking pin.

17. The system according to claim 15, wherein the constraint mechanism comprises a first side tube and a second side tube.

18. The system according to claim 15, further comprising a ramp that is releasably attached with the first space frame unit.

19. The system according to claim 15, further comprising a fifth space frame unit positioned between the first space frame unit and the second space frame unit.

20. The system according to claim 19, further comprising a sixth space frame unit positioned between the first space frame unit and the fifth space frame unit.

* * * * *